United States Patent [19]

Bouchon

[11] Patent Number: 4,882,468

[45] Date of Patent: Nov. 21, 1989

[54] FOUR ÉLECTRIQUE NOTAMMENT POUR TRAITEMENT THERMIQUE

[75] Inventor: Jean C. M. Bouchon, Meylan, France

[73] Assignee: La Physique Appliquee Industrie, Pariset, France

[21] Appl. No.: 240,771

[22] Filed: Sep. 2, 1988

[30] Foreign Application Priority Data

Sep. 4, 1987 [FR] France ..... 87 1216

[51] Int. Cl.[4] ..... H05B 3/62

[52] U.S. Cl. ..... 219/400; 219/390

[58] Field of Search ..... 219/400, 390, 385, 386, 219/405, 411

[56] References Cited

U.S. PATENT DOCUMENTS

| | | | |
|---|---|---|---|
| 657,202 | 9/1900 | McBrair | 219/390 |
| 2,767,297 | 10/1956 | Benson | 219/411 |
| 3,167,642 | 1/1965 | Reis | 219/411 |
| 3,588,305 | 6/1971 | Seelandt | 219/386 |
| 4,235,592 | 11/1980 | Smith | 219/400 |
| 4,564,744 | 1/1986 | Valentin | 219/405 |

*Primary Examiner*—Teresa J. Walberg

*Attorney, Agent, or Firm*—Marshall, O'Toole, Gerstein, Murray & Bicknell

[57] ABSTRACT

An electric furnace (1), particularly for the heat treatment of workpieces constituting a charge (22) to be treated, concludes an outer casing (2) having two complementary parts adapted to be coupled and movable relative to one another, and, in said casing, at least one support (23) for the charge to be treated and at least one electric heating element (3). The furnace has at least two parts (1*a*, 1*b*), the first (1*b*) of which includes the support (23) for the charge (22) to be treated and a first part (6) of the outer casing (2), and the second (1*a*) of which includes the second part (5) of the outer casing (2) and a movable support (13, 14, 15) for permitting the two parts (1*a*, 1*b*) to move relative to one another. The first and second parts of the outer casing extend respectively over a part of the periphery of the charge to be treated in such a manner that the edges of the second part (5) thereof are outside the path of the charge to be treated. The second part (5) of the outer casing (2) extends, in the coupled position, above the charge to be treated, so as to free the vertical access to the charge support when said parts (1*a*, 1*b*) of the furnace are uncoupled.

13 Claims, 3 Drawing Sheets

FOUR ELECTRIQUE NOTAMMENT POUR TRAITEMENT THERMIQUE

The present invention relates to an electric furnace, particularly for the heat treatment of one or more workpieces constituting a charge to be treated, optionally under pressure, in a vacuum, or in controlled atmospheres.

At the present time various types of electric heat treatment furnaces are known. Some of them, which have a front charging door, require the use of a charge carrier and discharge arm penetrating into the furnace and having the disadvantage that these operations give rise to relative displacements of the workpieces in relation to one another, particularly when these workpieces constitute an assembled unit undergoing treatment.

Other furnaces have a sole receiving the charge to be treated, and also a bell-shaped casing covering the charge. For the purpose of charging or discharging, either the sole or the bell is moved vertically relative to the other of these components. Other furnaces also have a pit-like chamber open at the top and provided with a cover, the charge being introduced or extracted vertically through the top opening. These known furnaces have in particular the disadvantage of requiring a considerable available height for the movement of the movable component and for their charging and discharging.

The present invention proposes an electric furnace whose structure enables the disadvantages of known electric furnaces to be avoided, and which provides advantages which will become clear further on.

The electric furnace, particularly for the heat treatment of workpieces forming a charge to be treated, to which the present invention relates, comprises an outer casing consisting of two complementary parts adapted to be coupled and movable relative to one another, and, in said casing, at least one support for the charge to be treated and at least one electric heating element.

According to the present invention this electric furnace comprises at least two parts, the first of which parts comprises the support for the charge to be treated and a first part of said outer casing, and the second of which parts comprises the second part of said outer casing and means for displacing the two parts relative to one another, at least in the direction lateral to the charge to be treated, for the purpose of coupling and uncoupling them, the first and second parts of the outer casing extending respectively over a part of the periphery of the charge to be treated in such a manner that the edges of the second part thereof are outside the path of the charge to be treated, while the second part of the outer casing extends, in the coupled position, above the charge to be treated, so as to free the vertical access to the charge support when said parts are uncoupled.

Said heating element generally extends between the charge to be treated and said outer casing. In this case, according to the present invention, this heating element is preferably composed of at least two parts, formed respectively facing said parts of said outer casing and associated respectively with said parts of the furnace.

In certain cases, particularly in the case of cold wall furnaces, a thermal insulation shield may be provided between said electric heating element and said outer casing. According to the present invention this shield is preferably composed of at least two parts, which extend respectively facing the parts of said outer casing and which are associated respectively with the two parts of the furnace.

In one particular variant embodiment of the present invention said outer casing is spherical and divided into two parts extending one above the other, the bottom part being associated with the support of the charge to be treated, and the joint plane of said spherical outer casing preferably being an inclined diametrical plane.

According to the present invention said electric heating element and/or said thermal insulation shield is or are preferably respectively divided into two parts substantially in the zone of the joint plane of said outer casing.

According to the present invention said electric heating element and/or said thermal insulation shield is or are preferably substantially cylindrical and vertical, the joint plane of said outer casing being such that their top and bottom planes respectively extend substantially in the parts of the outer casing.

The electric furnace according to the present invention may in addition include at least one auxiliary device extending or disposed in the zone of the horizontal center plane of said spherical outer casing, between the latter and said vertical cylindrical heating element and/or said vertical cylindrical shield, which auxiliary device may for example comprise means for circulating a gas, optionally under pressure, in said outer casing and at least one heat exchanger. Other auxiliary devices may also be disposed in the largest free inside space facing the spherical outer casing.

According to the present invention, in a variant embodiment said means for displacing the two parts of the furnace relative to each other comprise on the one hand means for laterally displacing these to parts for the purpose of freeing the vertical access to the support of the charge to be treated, and on the other hand means for displacing them vertically for the purpose of coupling or uncoupling them.

The present invention will be better understood on study of a particular electric furnace, which is described by way of non-limitative example below and illustrated in the drawings, in which.

Figure 1:
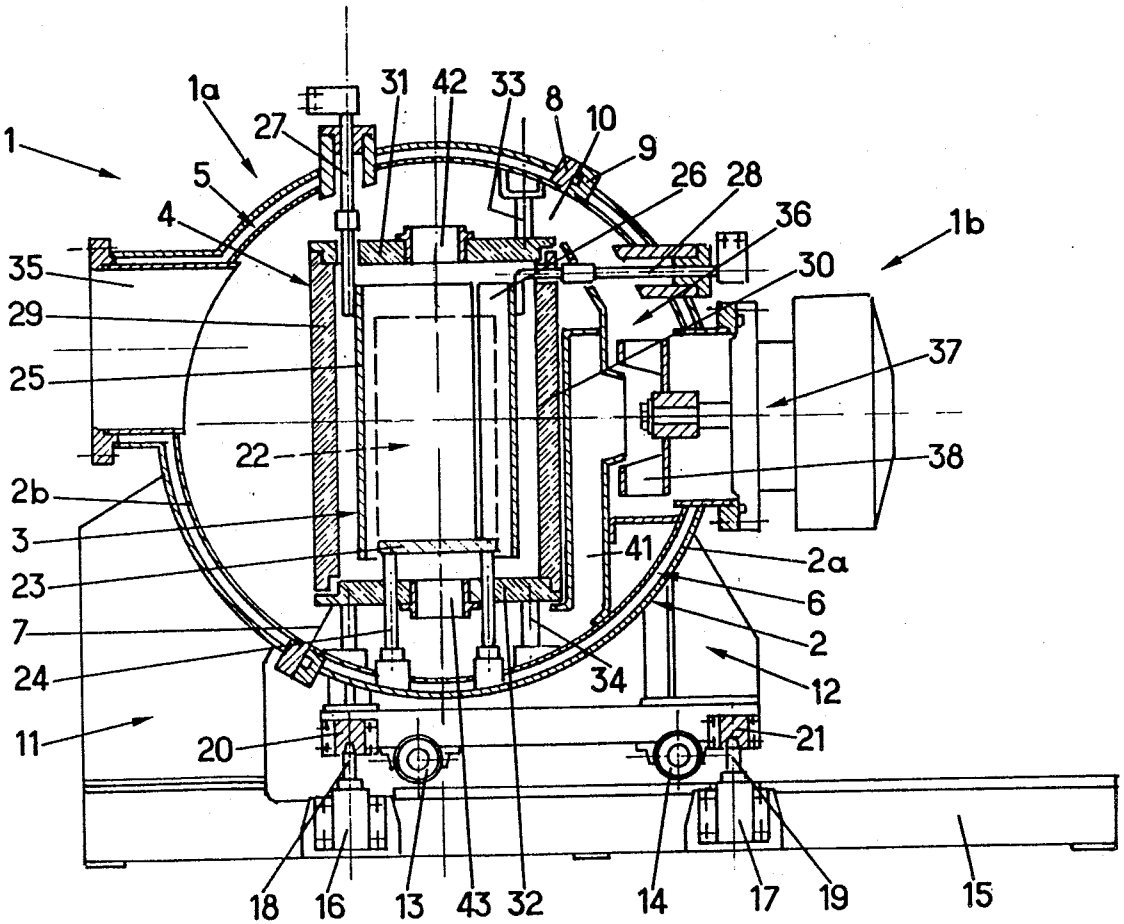
FIG. 1 shows in vertical median section an electric furnace according to the present invention, in the closed position.

Referring to the drawings, it will be seen that the electric furnace shown, indicated by the general reference 1, is composed of two parts 1*a* and 1*b* and comprises an outer casing given the general reference 2, and, in said casing, an electric heating element given the general reference 3, together with a thermal insulation shield given the general reference 4 and disposed between the electric heating element 3 and the outer casing 2 delimiting a chamber.

Figure 2:
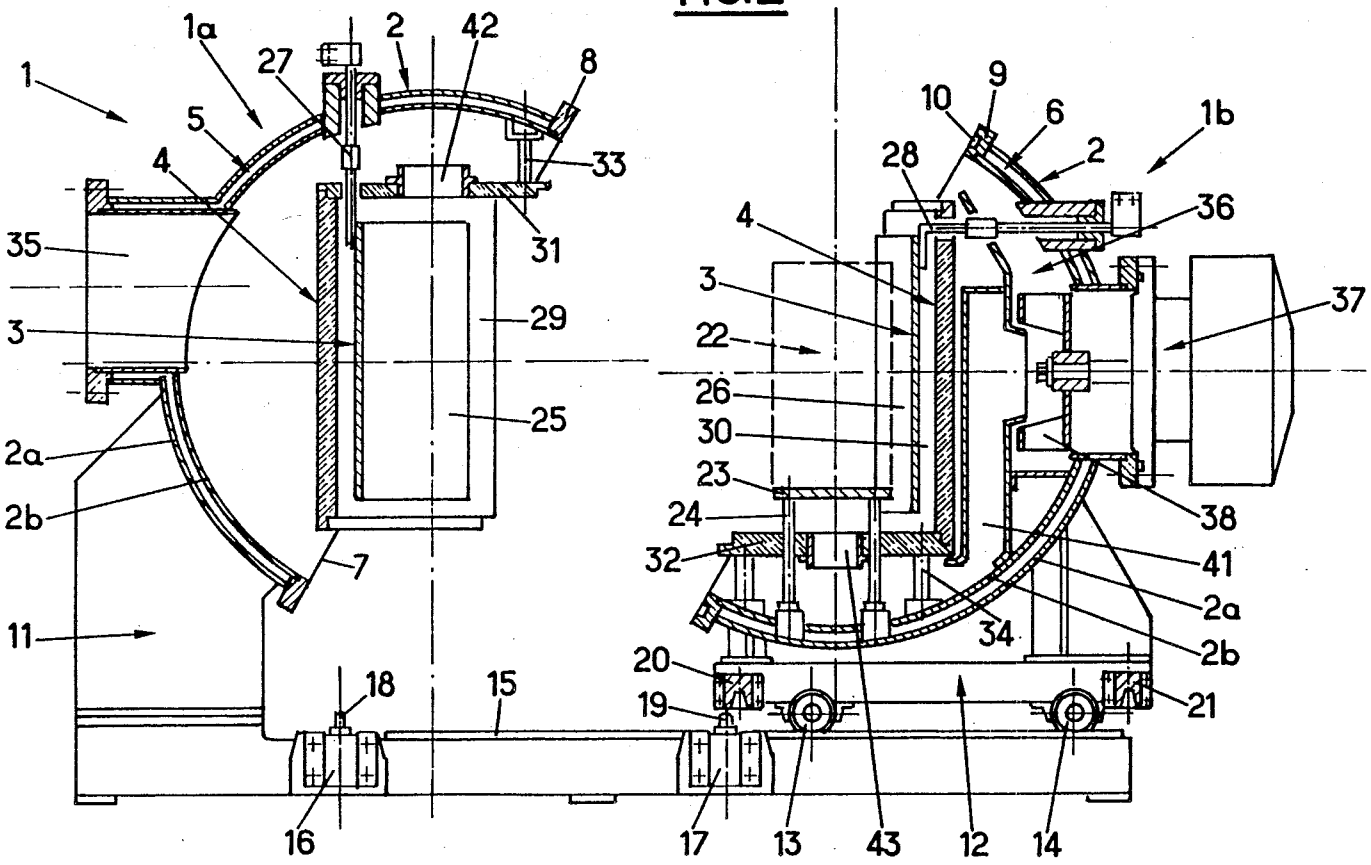
FIG. 2 shows in the open position the electric furnace shown in FIG. 1.

The outer casing 2 is composed of two hemispherical parts 5 and 6 whose diametrical joint plane 7 extends at right angles to the plane of FIGS. 1 and 2 and is inclined at about 30° to the vertical, the part 5 being above the part 6. These hemispherical parts 5 and 6, which respectively belong to the parts 1*a* and 1*b* of the furnace 1, have double walls 2*a*, 2*b*, for example for the purpose of circulating a cooling fluid between these walls, which are respectively connected by rings or annular flanges 8 and 9 bearing one against the other in positions coinciding with the joint plane 7, the flange 9 having a cavity 10 facing the flange 8 and adapted to receive a seal.

The hemispherical part 5 of the spherical outer casing 2 is mounted stationary on a frame given the general reference 11, while the bottom portion of the hemispherical part 6 is fixed on a movable frame given the general reference 12. At the bottom the frame 12 carries two pairs of rollers 13 and 14 adapted to come to rest on two parallel horizontal rails 15 on the frame 11, in such a manner as to be able to move the hemispherical part 6 of the spherical outer casing 2 parallel to the plane of FIGS. 1 and 2 for the purpose of bringing it away from or close to the fixed hemispherical part 5. Two pairs of jacks 16 and 17 having vertical axes are fixed on the frame 11, the top ends of their rods 18 and 19 being adapted to engage in corresponding cavities in receptacles 20 and 21 fixed on the bottom of the movable frame 12; these jacks 16 and 17 can be used in the following manner.

When the movable part 1*b* of the furnace 1, consisting of the movable frame 12 and the hemispherical part 6 of the outer casing 2 and supported on the rails 12 by means of the pairs of rollers 13 and 14, is disposed in such a manner that the flange 9 of the hemispherical part 6 corresponds vertically with the flange 8 of the hemispherical part 5 of the fixed part 1*a* of the furnace 1, the jacks 16 and 17 can be used to raise this movable part 1*b* so as to couple together the two hemispherical parts 5 and 6 of the outer spherical outer casing at the joint plane 7, and conversely can be used to uncouple them, the corresponding vertical stroke being relatively short in relation to the diameter of the outer casing 2.

For the charge 22 to be treated the outer casing 2 contains a support in the form of a circular table 23, whose top face, receiving the charge 22, is horizontal and whose axis coincides with the vertical axis of the spherical outer casing 2. This charge support 23, which is disposed in the bottom part of the spherical outer casing 2 substantially at quarter height and whose diameter is about one-fourth of the diameter of said casing, is carried by vertical legs 24 whose bottom ends are fixed to the bottom of the hemispherical part 6 of the outer casing 2, so that this charge support 23 belongs to the movable part 1*b* of the furnace 1. The hemispherical part 6 of the outer casing 2 thus extends laterally to and below the charge 22, and the hemispherical part 5 extends laterally to and above the charge 22.

In this example the electric heating element 3 is composed of two plates 25 and 26 of complementary shape, delimiting a hollow cylinder having a vertical axis coinciding with the vertical axis of the spherical outer casing 2, these plates 25 and 26 having slightly spaced vertical edges. This cylinder extends at the bottom around and at a distance from the peripheral edge of the charge support 23 and at the top around the charge 22 to be treated, symmetrically in relation to the horizontal center plane of the furnace 1.

Figure 3:
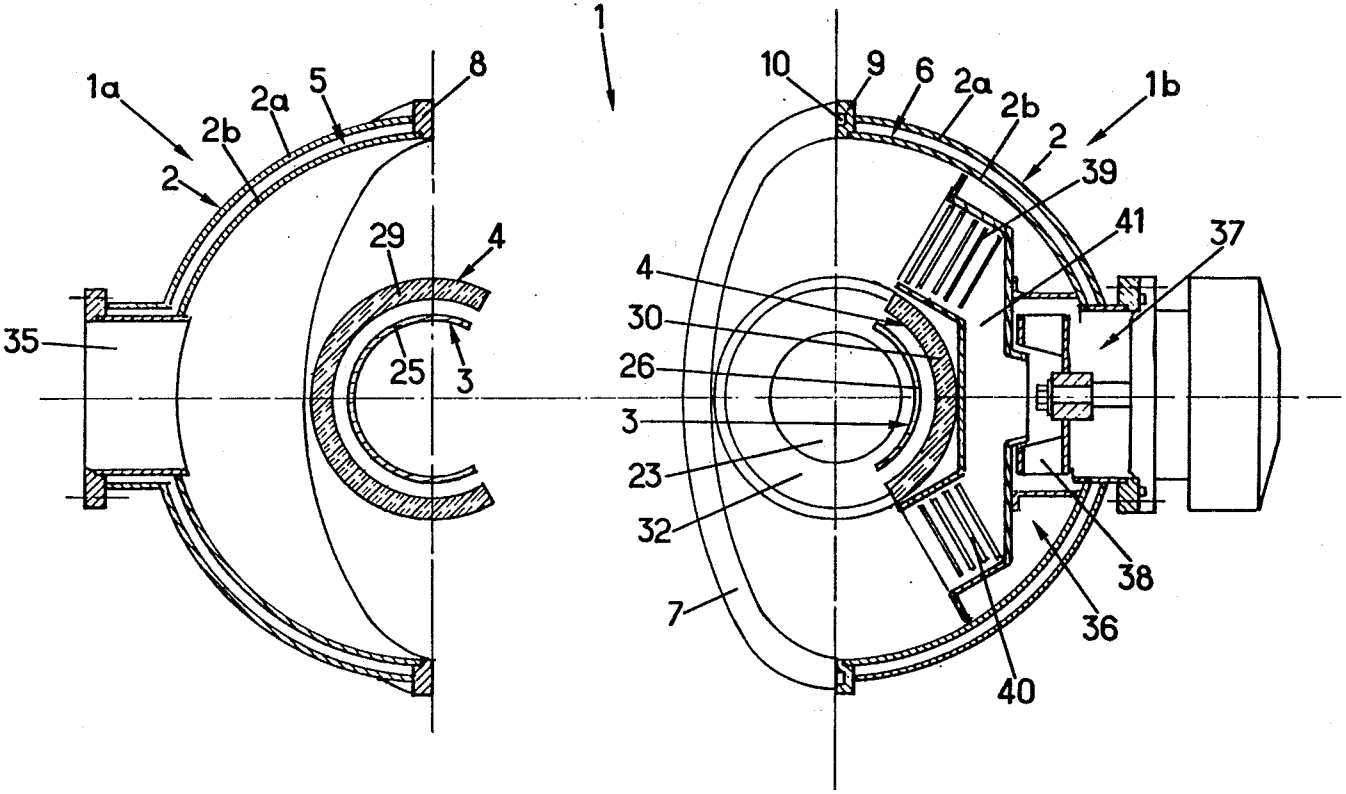
FIG. 3 shows in horizontal section through a center plane, in the open position, the electric furnace shown in FIG. 1.

As can be seen more particularly in FIG. 3, where it is shown in section, the part 25 of the electric heating element 3 is situated on the side of the spherical outer casing 2 composed of the hemispherical part 5 and extends over slightly more than half the periphery of the charge support 23, or of the charge 22, symmetrically in relation to the plane of FIG. 1, while the part 26 of said heating element is situated on the side of the outer casing 2 composed of the hemispherical part 6 and is complementary to the part 25.

The parts 25 and 26 of the electric heating element 3 are respectively carried by bars 27 and 28 which form electrical connections and are respectively fixed on the hemispherical parts 5 and 6 of the outer casing 2 and extend through said parts, so that they belong respectively to the two parts 1*a* and 1*b* of the furnace 1.

The parts 25 and 26 of the electric heating element 3 could, in variants, be subdivided and could optionally have top and/or bottom parts extending above and below the charge 22 and fastened respectively to the parts 25 and 26.

The thermal insulation shield 4, likewise composed of two parts, comprises a vertical cylindrical wall whose axis is identical with that of the cylindrical heating element 3. This cylindrical wall is composed of two parts 29 and 30 whose vertical edges are contiguous and which extend facing the parts 25 and 26 of the heating element 3 and project upwards and downwards substantially the same distance beyond the top and bottom edges of said heating element.

The insulation shield 4 is in addition provided with a circular top cover 31 which extends horizontally above the charge 22 and is fixed to the top edge of the vertical part 29, and also with a bottom cover 32 which extends horizontally below the charge support 23 and is fixed to the bottom edge of the part 30, the legs 24 of the charge support 23 passing through said bottom cover 32.

It can be observed that the top cover 31 extends in the hemispherical part 5 of the outer casing 2, while the bottom cover 32 extends in the hemispherical part 6 of said casing, the covers 31 and 32 being respectively at a distance from the top and bottom edges of the cylindrical heating element 3.

The part 29 of the thermal insulation shield 4 and its top cover 31 are carried by the hemispherical part 5 of the spherical outer casing 2 with the aid of legs 33, so that they belong to the part 1*a* of the furnace 1.

The part 30 of the insulation shield 4 and its bottom cover 32 are carried by the hemisperical part 6 of the outer casing 2 with the aid of feet 34, so that they belong to the part 1*b* of the furnace 1.

The thermal insulation shield 4 is of known material and structure, being in particular of metal, and is composed of an assembly of superimposed layers, or is of thermal insulation material, such materials being adapted to the conditions of utilization of the furnace.

In the closed position shown in FIG. 1 the two parts 1*a* and 1*b* of the electric furnace 1 are coupled together in the manner described above, the movable frame 12 being carried by the rods 18 and 19 of the jacks 16 and 17.

In order to uncouple these parts 1*a* and 1*b* of the furnace 1 for the purpose of proceeding to discharge a treated workpiece 22 or to charge another workpiece 22 to be treated, the procedure may be as follows.

The jacks 16 and 17 are operated to lower their rods 18 and 19. The furnace part 1*b* is then lowered until the rollers 13 and 14 come to rest on the rails 15, as has previously been seen. When this is done, the frame 12, the hemispherical part 6 of the spherical outer casing 2, the charge support 23, the parts 30 and 32 of the thermal insulation shield 4, and the part 26 of the electric heating element 3 move downwards and are uncoupled from the corresponding parts of the furnace part 1*a*. With the aid of drive means (not shown), such as drive means turning the rollers 13 and 14, the furnace part 1*b* is moved along the rails 15 and is brought laterally away from the furnace part 1*a* to reach the open position shown in FIG. 2. In this position the top face of the charge support 23 is accessible from the side through the opening of the hemispherical part 6 of the outer casing 2, and is also accessible vertically, so that a charge 22 to be treated or a treated charge can be placed on or removed from the charge support 23 by lateral or vertical displacement, for example with the aid of a carrier cable, without being obstructed by any part of the furnace structure, since only the part 26 of the heating element 3 partly surrounds the charge support 23 over less than half of its extent and said charge support is freely accessible vertically and laterally to the angle covered by the part 25 of the heating element 3. The same remarks apply to the thermal insulation shield 4.

To effect the coupling of the parts 1*a* and 1*b* of the electric furnace 1, the reverse procedure is adopted. It can be seen that in section the arcs covered by the parts 25 or 26 of the electric heating element 3 have vertical edges which obstruct neither the passage of the charge 22 disposed on the support 23 nor the passage of the latter.

The hemispherical part 5 of the outer casing 2 is in addition equipped with a double walled external connection pipe 35, for the connection of, for example, a suction device such as a vacuum pump.

The furnace 1 is also equipped with an auxiliary device permitting the circulation of a gas inside the spherical outer casing 2, and with a heat exchanger given the general reference 36, this device 36 being associated with the part 1*b* of the furnace 1 and extending in the zone of the horizontal diametrical plane of the spherical outer casing 2 where the distance separating the vertical wall 29, 30 of the thermal insulation shield 4 and the inner wall of the spherical outer casing 2 is the longest. Other devices could obviously be installed in this zone, both in the hemispherical part 6 of the outer casing 2 and in the hemispherical part 5 of the latter.

As can clearly be seen in FIG. 3, the auxiliary device 36 is provided with a fan 37 whose axis extends along the horizontal axis on FIG. 1 and which passes through the wall of the hemispherical part 6 of the outer casing 2 and is carried by the latter, its propeller 38 being in said hemispherical part 6. On each side of the vertical plane of FIGS. 1 and 2 the auxiliary device 36 has a symmetrical tubular heat exchanger 39 and 40, whose connection lines (not shown) pass through the wall of the hemispherical part 6 of the outer casing 2 so as to be connected to all other heat exchange devices outside the furnace 1. In addition, the auxiliary device 36 is provided, inside the furnace 1, with separating walls which form a forced circulation corridor 41 in the heat exchangers 39 and 40 for the propeller 38 of the fan 37, the covers 31 and 32 of the insulation shield 4 having vertical passages 42 and 43 for the circulation of a gas around the charge 22.

The present invention is not restricted to the example described above. It would in fact have been possible to effect lateral displacement of the part 1*b* relative to the part 1*a* without an initial vertical displacement. It would have been possible for the part 1*b* of the furnace 1 to be made stationary and for the part 1*a* to be made movable. It would also have been possible to provide an outer casing 2, an electric heating element 3, and a thermal insulation shield 4 of completely different shapes, while permitting equivalent displacements of these two parts and equivalent charging and discharging operations.

I claim:

1. An electric furnace for heat treatment of a workpiece constituting a charge, said furnace comprising:
   - an outer casing having two complementary parts adapted to be coupled and movable relative to each other between coupled and uncoupled positions;
   - at least one support for said charge, said support being carried by a first part of said casing;
   - the furnace having two parts, a first furnace part comprising said first part of said outer casing and the charge support carried thereon and a second furnace part comprising a second part of said outer casing;
   - and means for displacing said two parts of the furnace relative to each other in a horizontal direction laterally between said coupled and uncoupled positions;
   - the coupling edges of the second part of the furnace being outside a path of the charge and the charge support of the first part of the furnace when the furnace parts are moved relative to each other;
   - said second part of the furnace in coupled position extending laterally above the charge support so that vertical access to the charge support in the first part of the furnace is free when the two furnace parts are uncoupled, whereby said workpiece can be vertically charged to and discharged from said furnace.

2. An electric furnace according to claim 1, wherein the first and second parts of the furnace comprise respectively first and second parts of an electric heating element which extend between the charge and the outer casing and face respectively the first and second parts of the casing.

3. An electric furnace according to claim 2, wherein the two parts of the electric heating element have coupling edges which are arranged substantially in correspondence with the coupling edges of the two parts of the outer casing.

4. An electric furnace according to claim 1, wherein the first and second parts of the furnace further include respectively first and second parts of a thermal insulation shield which extend between the electric heating element and the outer casing and face respectively the first and second parts of the casing.

5. An electric furnace according to claim 4, wherein the two parts of the thermal insulation shield have coupling edges which are arranged substantially in correspondence with the coupling edges of the two parts of the outer casing.

6. An electric furnace according to claim 1, wherein said means for displacing the two parts of the furnace relative to one another are provided outside said casing.

7. An electric furnace in accordance with claim 1, wherein said outer casing has a spherical shape, the coupling edges of said two parts thereof extending in an inclined diametrical plane such that, in coupled position, the first part of the outer casing extends laterally and below a charge carried by the charge support thereof and the second part thereof extends laterally and above said charge so that the coupling edge of the second part of the furnace is outside the path of the charge and the charge support and vertical access to the charge support is free when the two furnace parts are uncoupled.

8. An electric furnace according to claim 7, wherein the first and second parts of the furnace further include respectively first and second parts of a substantially vertical and cylindrical electric heating means which extends between the charge and the outer spherical casing, said parts of said electric heating means having coupling edges which are arranged substantially in correspondence with the coupling edges of the outer spherical casing, said heating means having bottom and top planes which extend respectively substantially in the first and the second parts of the outer spherical casing.

9. An electric furnace according to claim 8, wherein the first and second parts of the furnace further include respectively first and second parts of a substantially cylindrical and vertical thermal insulation shield means which extends between said electric heating means and the outer spherical casing, said shield having coupling edges which are arranged substantially in correspondence with the coupling edges of the outer spherical casing, said shield means having bottom and top planes which respectively extend substantially in the first and second parts of the outer spherical casing.

10. An electric furnace according to claim 9, comprising means for circulating gas in said outer spherical casing and at least one heat exchanger arranged in the space between the outer spherical casing and said cylindrical and vertical heating and shield means.

11. An electric furnace according to claim 8, comprising means for circulating gas in said outer spherical casing and at least one heat exchanger arranged in the space between the outer spherical casing and said cylindrical and vertical heating and shield means.

12. An electric furnace according to claim 7, further including means outside said spherical casing for vertically moving the parts thereof during their coupling and uncoupling.

13. An electric furnace for the heat treatment of a workpiece constituting a charge, said furnace comprising:

an outer casing having two complementary parts adapted to be coupled and movable relative to each other between coupled and uncoupled positions;

at least one support for said charge, said support being carried by a first part of said casing;

an electric heating means having two parts and extending between said charge support and the outer casing;

a thermal insulation shield means having two parts and extending between the electric heating means and the outer casing;

said electrical heating means and said thermal insulation shield means having substantially vertical cylindrical shapes;

the furnace having two parts, a first furnace part comprising said first part of said outer casing, a first part of said electric heating means and said charge support carried thereon, and a second furnace part comprising a second part of the outer casing, a second part of said electric heating means and a second part of said thermal insulation shield means;

means for displacing said two parts of the furnace relative to each other in a horizontal direction horizontal laterally between said coupled and uncoupled positions;

said outer casing having a spherical shape, the coupling edges of said two parts thereof extending in an inclined diametrical plane;

the coupling edges of respectively the two parts of said spherical outer casing, the two parts of said cylindrical electric heating means and the two parts of said cylindrical thermal insulation shield means being arranged such that the coupling edges of the second parts of the furnace is outside a path of the charge and vertical access to the charge support is free when the two furnace parts are uncoupled.

* * * * *